US010252281B2

(12) United States Patent
Chen et al.

(10) Patent No.: US 10,252,281 B2
(45) Date of Patent: Apr. 9, 2019

(54) JET TYPE SPRAY HEAD DOUBLE-LIMITING REVERSING MECHANISM

(71) Applicant: Jiangsu University, Zhenjiang (CN)

(72) Inventors: Chao Chen, Zhenjiang (CN); Hong Li, Zhenjiang (CN); Qingjiang Xiang, Zhenjiang (CN); Pan Tang, Zhenjiang (CN)

(73) Assignee: Jiangsu University (CN)

( * ) Notice: Subject to any disclaimer, the term of this patent is extended or adjusted under 35 U.S.C. 154(b) by 172 days.

(21) Appl. No.: 15/528,379

(22) PCT Filed: Dec. 3, 2014

(86) PCT No.: PCT/CN2014/092884
§ 371 (c)(1),
(2) Date: May 19, 2017

(87) PCT Pub. No.: WO2016/078140
PCT Pub. Date: May 26, 2016

(65) Prior Publication Data

US 2017/0320076 A1 Nov. 9, 2017

(30) Foreign Application Priority Data

Nov. 19, 2014 (CN) ..... 2014 1 0665549

(51) Int. Cl.
*B05B 3/00* (2006.01)
*B05B 3/04* (2006.01)
*B05B 1/16* (2006.01)

(52) U.S. Cl.
CPC ..... *B05B 3/04* (2013.01); *B05B 1/16* (2013.01); *B05B 3/0477* (2013.01); *B05B 3/0481* (2013.01)

(58) Field of Classification Search
CPC ..... B05B 1/16; B05B 3/04; B05B 3/0477; B05B 3/0481
(Continued)

(56) References Cited

U.S. PATENT DOCUMENTS 147,966 A * 2/1874 Palmeiri ..... B05B 3/0486 239/222.17
177,630 A * 5/1876 Foster ..... B05B 3/0486 239/222.17
(Continued)

FOREIGN PATENT DOCUMENTS

CN 101138756 A 3/2008
CN 101507953 A 8/2009
(Continued)

OTHER PUBLICATIONS

International Search Report re PCT/CN2014/092884, dated Jul. 28, 2015, 5 pgs.
(Continued)

*Primary Examiner* — Viet Le
(74) *Attorney, Agent, or Firm* — Greenberg Traurig, LLP

(57) ABSTRACT

The present application belongs to fluid control equipment, in particular, relates to directional controlling mechanism of fluidic sprinkler, comprising a rear reversing mechanism, a front reversing mechanism and a signal stream switching mechanism. A limiting shift rod of the rear mechanism rotate around a locating rod as the center after touching a limiting ring, then realize the reversing of the limiting shift rod. The reverse action of the limiting rod will finally lead a reversing arm to rotate by way of driving a reversing locating block, a rear reversing rod and a front reversing rod to rotate. The rear reversing mechanism, the front reversing mechanism and the signal stream switching mechanism act together, so as to switch a left-side signal stream nozzle and a right-side stream nozzle of a fluidic sprinkler, and bring about the
(Continued)

reversing of the rotation direction of the fluidic sprinkler. Directional controlling mechanism of fluidic sprinkler is in a stepping state respectively in the clockwise and the counter clockwise working modes, so that the impact force on a rotary body is small, critical components tend to have a longer working life, an intermediate position does not exist during the reversing of the sprinkler, and the switching of the sprinkler is stable and reliable.

8 Claims, 4 Drawing Sheets

(58) Field of Classification Search
USPC ..... 239/222, 222.13, 222.17, 222.19
See application file for complete search history.

(56) References Cited

U.S. PATENT DOCUMENTS 442,865 A * 12/1890 Kinder ..... B05B 3/1014 239/224
453,055 A * 5/1891 Ware ..... B05B 3/0486 239/222.17
587,662 A * 8/1897 Schulte ..... B05B 3/0486 239/222.17
588,846 A * 8/1897 White ..... A01G 25/095 239/745
706,986 A * 8/1902 Moderson ..... B05B 3/0486 239/222.17
893,354 A * 7/1908 McGregor ..... A61M 11/06 239/222.17
1,055,411 A * 3/1913 McWilliams et al. ..... B05B 3/1007 239/104
1,147,513 A * 7/1915 Kirk Patrick ..... B05B 3/02 169/37
1,239,229 A * 9/1917 Shaw ..... B05B 3/06 239/222.17
1,239,230 A * 9/1917 Shaw ..... B05B 1/265 239/222.17
1,342,027 A * 6/1920 Murphy ..... F23D 11/10 239/117
2,249,211 A * 7/1941 Johnson ..... A01G 25/09 239/222.17
3,559,887 A * 2/1971 Meyer ..... B05B 3/003 239/233
3,788,551 A * 1/1974 Standal ..... B05B 3/044 239/242
4,094,467 A * 6/1978 Meyer ..... B05B 3/0477 239/230
4,153,202 A * 5/1979 Meyer ..... B05B 3/063 239/230
4,342,424 A * 8/1982 Meyer ..... B05B 3/0481 239/233
4,720,045 A * 1/1988 Meyer ..... B05B 3/0477 239/230
6,364,217 B1 * 4/2002 Lockwood ..... B05B 15/70 239/242
6,607,147 B2 * 8/2003 Schneider ..... B05B 3/0477 239/230
7,938,339 B2 * 5/2011 Robert ..... A61L 2/22 239/214.15
8,905,326 B2 * 12/2014 Greenwood ..... B63H 11/00 239/225.1
2002/0158145 A1 * 10/2002 Schneider ..... B05B 3/0477 239/241
2010/0163644 A1 * 7/2010 Dieziger ..... B05B 3/003 239/222.17
2012/0318889 A1 * 12/2012 Gorny ..... B05B 3/06 239/222.17
2013/0270360 A1 * 10/2013 Mitchell ..... B05B 1/086 239/160
2014/0263734 A1 * 9/2014 Kim ..... B05B 3/003 239/222.17
2015/0265821 A1 * 9/2015 Shi ..... A61B 17/00491 604/289
2017/0120312 A1 * 5/2017 Hoffmeyer ..... B05B 3/04
2017/0320076 A1 * 11/2017 Chen ..... B05B 3/04
2018/0116135 A1 * 5/2018 Block ..... A01G 25/02

FOREIGN PATENT DOCUMENTS

CN 109172722 A 2/2011
CN 102962149 A 3/2013
CN 102962152 A 3/2013
CN 103230851 A 8/2013
JP 2009165967 A 7/2009

OTHER PUBLICATIONS

Li, Hong et al., Theory and structure design of two-ways step running complete fluidic sprinkler of PXSB type, Drainage and Irrigation Machinery, vol. 26, No. 5, Sep. 2008, Technical and Research Center of Fluid Machinery Engineering, Jiangsu University, Zhenjiang, Jiangsu 212013, China, 5 pgs.

* cited by examiner

JET TYPE SPRAY HEAD DOUBLE-LIMITING REVERSING MECHANISM

CROSS REFERENCE TO RELATED APPLICATION

This application is a national stage application under 35 U.S.C. § 371 claiming priority from International Application No. PCT/CN2014/092884, filed Dec. 3, 2014, entitled "Directional Controlling Mechanism of Fluidic Sprinkler" which in turn claims priority to Chinese Application 201410665549.2, with the same title, filed Nov. 19, 2014 and incorporated herein by reference in its entirety.

FIELD OF THE DISCLOSURE

The application belongs to fluid control equipment, in particular, relates to directional controlling mechanism of fluidic sprinkler, attributing to the technical field of a jet device.

BACKGROUND OF RELATED ART

Sprinklers are one of the key pieces of equipment in an irrigation system, and its performance directly affects the quality of sprinkling irrigation. Theory and structural design of two-ways step running complete fluidic sprinkler of PXSB type (Drainage and Irrigation Mechanical, 2008, fifth) purpose a bi-directional stepping fluidic sprinkler. The working principle of which is adding a bi directional stepping reversing mechanism on the basis of the original sprinkler, thereby changing the rotation direction of the sprinkler by changing the location of the spool in the reversing mechanism and switching the direction of the signal stream, such that bi directional stepping is reached. Chinese patent No. CN101972722 entitled "external water intake jet wall control element", when compared with the traditional fluidic sprinkler, shows the external water intake signal external water intake is located at the outside of the outlet cover. The injector intakes signal water and air to discontinuity form a low-pressure vortex in one side of the jet so as to make flow attach the wall and promote the rotation of the sprinkler. The high and low pressure on the either side of the main jet is switched through the opening and closing of the reverse air hole, so that a reversing motion is realized. The sprinkler is simple and reliable, but when the sprinkler is used for remote jet sprinkler, reversing process is continuous motion such that greater reversing impact force will contribute to the abrasion of the reversing mechanism, and signal nozzle is lashed by high-speed main jet causing the abrasion of the signal nozzle and the wear nozzle is difficult to adjust, all the shortage above will lead to the shot life of the sprinkler. In Chinese patent No. CN 102962149A entitled "reversing control mechanism of fluidic sprinkler," the inverting mechanism, limiting device, nozzle and pipe of the present application coordinate each other to realize forward stepping, backward steeping and switching of the sprinkler. However, the reference has a nozzle that is easy to abrade, contributing to the decline of service life of the sprinkler. China Patent No. CN102962152A entitled "bi directional synchronous fluidic sprinkler", the sprinkler is two-way step motion which solve the problem that the impact force produced by reversing process of the fluidic sprinkler abrade the reversing mechanism. However, in the process of reversing the switch, there is an intermediate state, which leads to the signal stream nozzle does not intake water and influence the stability of the sprinkler. In view of drawbacks of the patents mentioned above, the present applications provides a directional controlling mechanism of fluidic sprinkler, solving the problem that bi directional synchronous fluidic sprinkler does not stable in the switching process effectively.

SUMMARY

The present application aims to overcome the defects of the existing technology, to provide a directional controlling mechanism of fluidic sprinkler with a stable, reliable and reasonable structure, to further enhance and improve the performance of the existing fluidic Sprinkler, to make sprinkler work and switch stably.

The technical scheme for solving the technical problem of the application is that the directional controlling mechanism of fluidic sprinkler comprising front and rear reversing mechanism, reversing mechanism and signal stream switching mechanism. The limiting shift rod of the rear reversing mechanism rotate centered at a locating rod under the driving force of the nozzle after touching a limiting ring, the limiting shift rod will rotate to the other side rapidly under the spring pre load when the limiting shift rod rotate to the vertical position, meanwhile reversing positioning block is driven. The rear reversing rod will rotate due to the change of the reversing positioning block and the rear reversing rod of the front reversing mechanism rotates around the rear rotating axis will drive the reversing spring to change. Under the force of the reversing spring, the front rotating rod is reversing rod rotates centered at a front rotating axis, and the reversing arm rotates. The front reversing mechanism, the rear reversing mechanism and the signal stream switching mechanism cooperate so perfectly that left signal stream nozzle and right signal stream nozzle switch successfully and the rotation direction of the fluidic sprinkler is changed.

The first bearing of the directional controlling mechanism of fluidic sprinkler is two bearings, so as to limit the rotation displacement of the reversing rod in the vertical direction, and reduce the friction resistance between the rear reversing rod and the rear rotating shaft.

The included angle between the limiting rod and the center line of the reversing positioning block satisfied $\alpha \leq 170$, $\beta \leq 170°$. The axis of rear rotation axis, the front rotation axis and the spray body are in the same section. The rotation angle of the front reversing rod meet $5° \leq \gamma \leq 15°$. The distance between the cover plate and the inlet center of the left signal nozzle and the right signal nozzle is 1 mm$\leq L \leq$2 mm. The deflection between the left signal nozzle and lever is $\varepsilon \leq 15°$, and the deflection between the right signal nozzle and lever is $\delta \leq 15°$.

Advantages of the present application are as follows: the impact force of the directional controlling mechanism of fluidic sprinkler on rotating body is tiny, the present application has a long service life, the application work in the state of stepping whether in clockwise or anticlockwise, and there is no intermediate position in the reversing process of the nozzle so that the nozzle is stable and reliable.

BRIEF DESCRIPTION OF THE DRAWINGS

FIG. 2 is a cross-sectional view taken across line A-A in FIG. 1.

DETAILED DESCRIPTION

Figure 1:
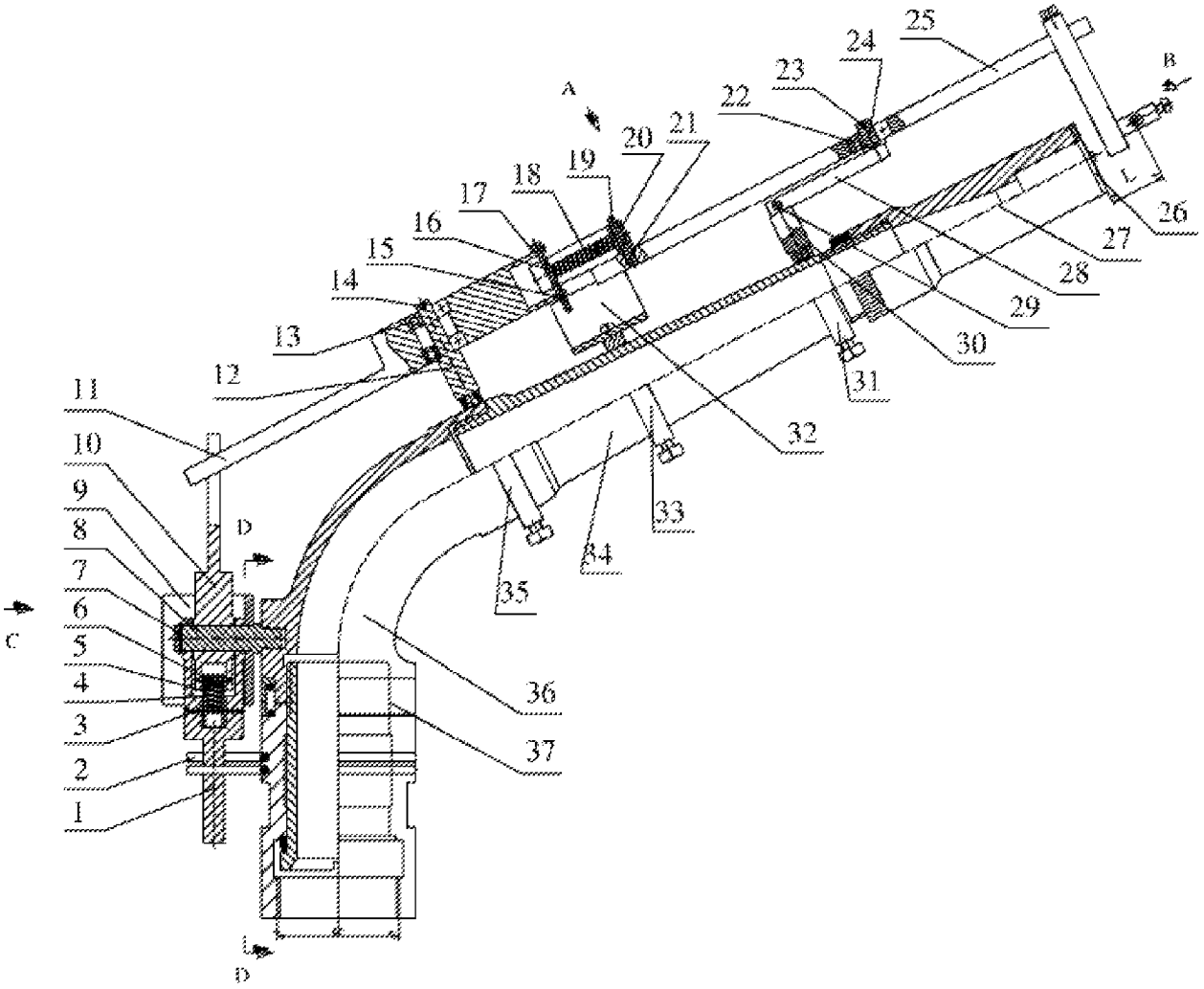
FIG. 1 is a front view of a fluidic sprinkler.

In the description of the present application, it is necessary to understand some terms, such as "center"; "endwise", "transverse" and "length" and "width" and "thickness", "above" and "below", "front" and "rear", "left" and "right" and "vertical" and "horizontal", "top" and "bottom" "inside" and "outside", "clockwise", anticlockwise," the direction or position, of which, indicates the direction or position based on the drawing. The terms mentioned above are only used to describe the application and facilitate the description, rather than the indicate device or element referred to must have a particular position, by which the application is constructed and operated.

In addition, the terms such as "first", "second" are used only for describing purpose and should not to be interpreted as the indication to the relative importance or to amount of the technical characteristics. Thus, the characteristics of the "first" and "second" are used to express or indicate to one or more features. In the description of the present application, the meaning of "multiple" is two or more than two features, unless other specific limiting is presented.

In the present application, the terms such as "install", "link", "connect", "fix", etc. should be broadly understood unless other specific regulations and limitation are presented. For example, the connection can be fixedly connection, be detachably connection or as a whole; be a mechanical connection, be electrically connected; be directly connected, be indirectly connected through an intermediary, even be connection between two internal component and interrelation of two element. One of ordinary skill in this field can understand the implication of the terms in the present application according to specific conditions.

In the present application, unless other specific regulation and limitation is presented, the meaning of first feature above or below second feature can be first feature contact second feature directly, or it can also be arranged such that first feature contacts second feature through another feature rather than directly. Furthermore, the position word "above," top," "on," or "between" first feature and second feature should include first feature being above or oblique above second feature and the first feature high than second feature in highlight. The position word "below," under," "down," between first feature and second feature should include first feature being below or oblique below second feature and the first feature low than second feature in highlight. The following is further illustration with the figures showing specific embodiments, but the protection scope of the application is not only limited to these.

Figure 2:
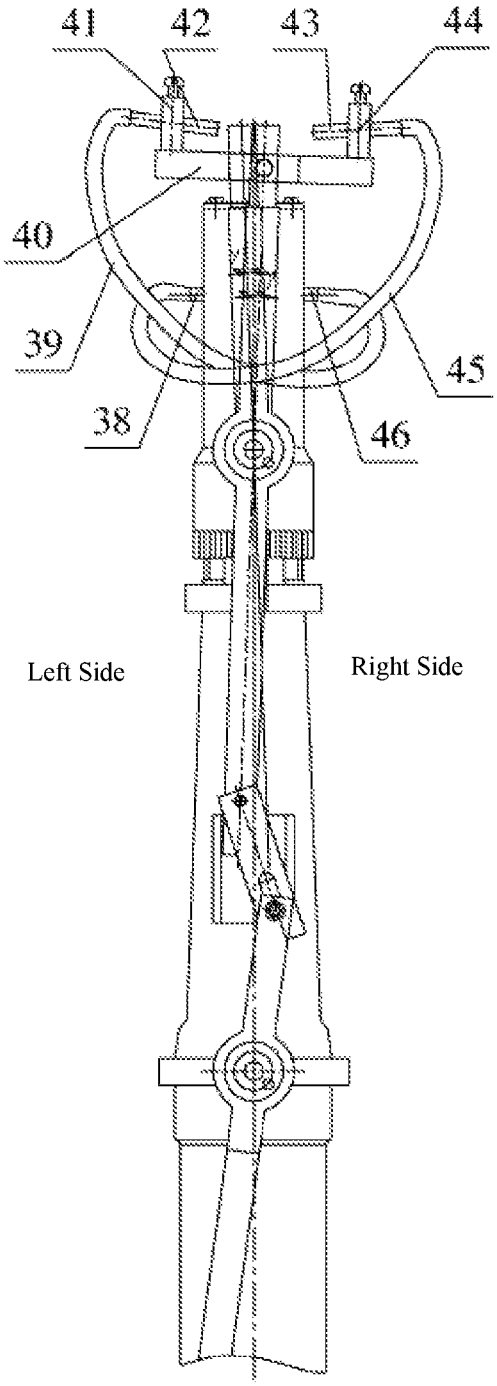
FIG. 2 is a perspective view of an example of the safety device according to the teachings of the present disclosure in another direction.
Figure 4:
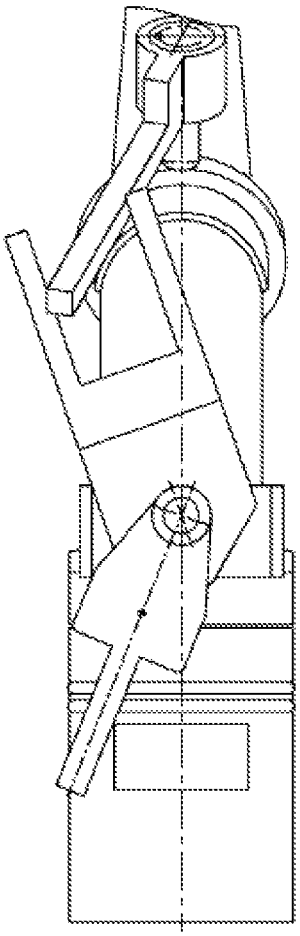
FIG. 4 is a cross-sectional view taken across line C-C in FIG. 1.

As shown in FIG. 1, FIG. 2 and FIG. 4, a directional controlling mechanism of fluidic sprinkler includes front and rear reversing mechanism, reversing mechanism, signal stream switching mechanism apply the present application. The limiting rod 1 of the reversing mechanism rotates with the locating rod 8 after touching a limiting ring 2. Thereupon, the limiting rod 1 rotates to other side rapidly with the force of the adjusting spring 4 while the limiting rod 1 rotates up to the vertical position and, simultaneously, drives the motion of the reversing positing block 10, which will drive the rear rotation in a reverse direction. The rear reversing rod 11 of the front reversing mechanism rotates with the rear rotating axis 12 will drive the reversing of the reversing spring 18, the front reversing 25 rotate with the front rotation axis 24 and drives the reversing arm 40 rotating in the force of the reversing spring 18. The reversing mechanism, the front reversing mechanism and the signal stream switching mechanism cooperate each other so as to realize the switching of the left signal nozzle 42 and t the right signal nozzle 43, such that the reversing of rotation direction of the fluidic sprinkler can be realized.

The rear reversing mechanism includes limiting rod 1, liming ring 2, first limiting pin 3, adjusting spring 4, sleeve 5, first pin 6, second pin 7, positioning rod 8, limiting sleeve 9, reversing positing block 10, spray body 36, limiting screw 47. The positioning rod 8 is arranged in the spray body 36 and the limiting sleeve 9 is press fit outside of the spray body 36. The limiting screw 47 go through the limiting sleeve 9 and is fixed on the spray body 36 so as to limit the limiting sleeve 9 rotating centered at the positioning rod 8. The limiting rod 1 and the reversing positing block 10 are installed on the positioning rod 8. The second pin 8 is fixed on the positioning rod 8 to limit the axial displacement of the limiting rod 1 along the positioning rod 8. The sleeve 5 is positioned on the inside of the positioning block 10 by the first pin 6. The adjusting spring 4 is arranged in the sleeve 5, with the first limiting pin 3 which is fixed on the limiting rod 1 to limit the position of lower end of the adjusting spring 4.

The front reversing mechanism includes rear reversing rod 11, rear rotation axis 12, first bearing 13, third pin 14, fourth pin 15; second spacer pin 16, shim 17, reversing spring 18, fifth pin 19; spring sleeve 20, locating axis 21; second bearing 22, sixth pin 23, front rotation axis 24, front reversing rod 25, extension plate 28, pre-stressed bolt 29, short supporting bar 30, minor spacing ring 31, reversing plate 32, medium spacing ring 33, jet tube 34, and larger spacing ring 35. The minor spacing ring 31, medium spacing ring 33 and larger spacing ring 35 are respectively fixed on the outside of the jet tube 34 by a fastening bolt. The rear rotation axis 12 is installed on the larger spacing ring 35. The first bearing 13 is arranged between the rear reversing rod 11 and the rear rotation axis 12. The first bearing 13 has two bearings so as to limit the rotation motion of the rear reversing rod 11 in vertical direction and reduce the friction resistance between the rear reversing rod 11 and the rear rotation axis 12. The third pin 14 inserts through the hole on top of the rear rotation axis 12 to limit vertical motion of the first bearing 13. The short supporting bar 30 is fixed on the minor spacing ring 31. One end of the extension plate 28 is arranged on the top of the short supporting bar 30 and the connection is fastened by the pre-stressed bolt 29. The front rotation axis 24 is installed on the pre-stressed bolt 29. The second bearing 22 is fixed between the front rotation axis 24 and the front reversing rod 25. The sixth pin 23 is inserted through the hole on top of the front rotation axis 24 to limit axial displacement of the second bearing 22. The rear rotation axis 12, the front rotation axis 24 and the spray body 36 are in the same section. The locating axis 21 is built in one end of the front reversing rod 25. The spring sleeve 20 is put on the locating axis 21. The fifth pin 19 is inserted through the hole on top of the locating axis 21 to limit axial displacement of the spring sleeve 20. The reversing spring 18 is mounted in the spring sleeve 20. The second spacer pin 16 limits the position of one end of the reversing spring 18, which is fixed in the hole of the rear reversing rod 11. The fourth pin 15 is inserted through the hole on top of the second spacer pin 16 to limit vertical displacement of the second spacer pin 16. The shim 17 is arranged on the second spacer pin 16 so as to reduce friction between the second spacer pin 16 and the rear reversing rod 11. The reversing plate 32 is press fit on the outside of the medium spacing ring 33 by tightening screw, and therefore, the rotation angle of the second spacer pin 16 and the front reversing rod 25 can be controlled from 5° to 10°.

As shown in FIG. 2, the signal stream switching mechanism includes left inlet tubule 38, left signal pipe 39, reversing arm 40, left supporting rod 41, left signal nozzle 42; right signal nozzle 43, right supporting rod 44, right signal pipe 45; right inlet tubule 46. The left supporting rod 40 is fixed on the front end of the front reversing rod 25 by tightening screw. The left supporting rod 41 and the right supporting rod 44 are respectively installed on the reversing arm 40. The left signal pipe 39 is mounted in the hole of the left supporting rod 41 by a tightening screw and the right signal nozzle 43 is mounted in the hole of the right supporting rod 44 by a tightening screw. The left inlet tubule 38 and the right inlet tubule 46 are all arranged on the fluidic element 27. The left inlet tubule 38 is connected to the right inlet tubule 46 by the left signal pipe 39 and the right signal nozzle 43 is connected with the left inlet tubule 38 by the right signal pipe 45.

Figure 3:
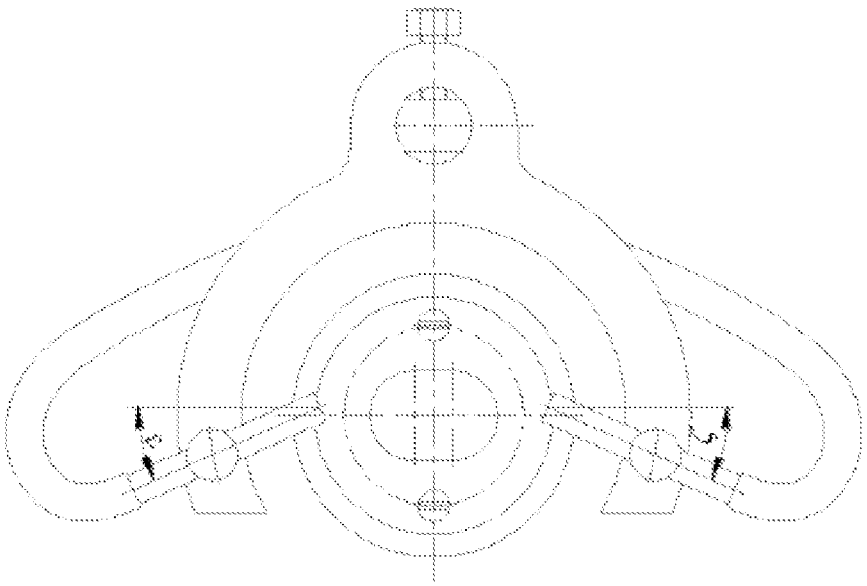
FIG. 3 is a cross-sectional view taken across line B-B in FIG. 1.

As shown in FIG. 1 and FIG. 3, the distance between the intake center of the left signal nozzle 42 and the right signal nozzle 43 and the cover plate 26 is controlled among 1 mm to 2 mm; the deflection between the left signal nozzle 42 and level is $\varepsilon \leq 15°$ and the deflection between the right signal nozzle 43 and level is $\delta \leq 15°$.

Figure 5:
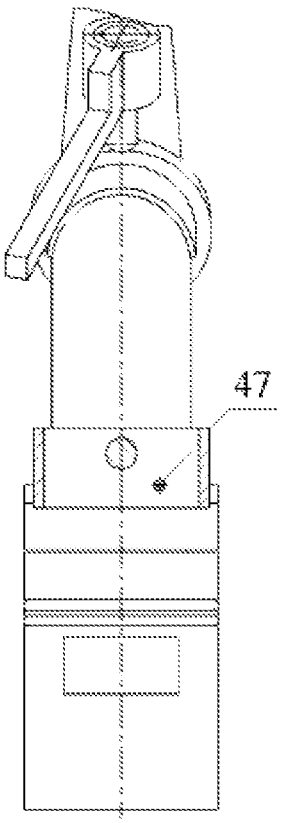
FIG. 5 is a cross-sectional view taken across line D-D in FIG. 1.
Figure 6:
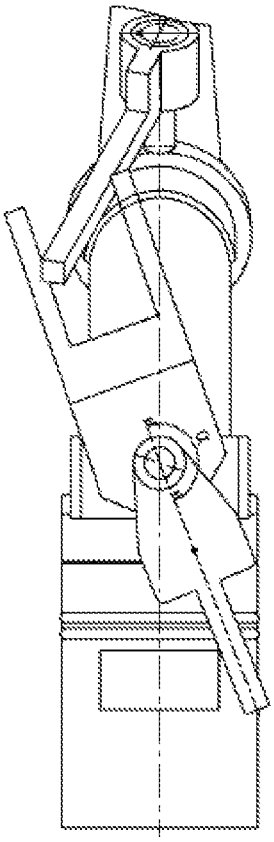
FIG. 6 is a schematic diagram of the limiting rod when fluidic sprinkler in reversing position.
Figure 7:
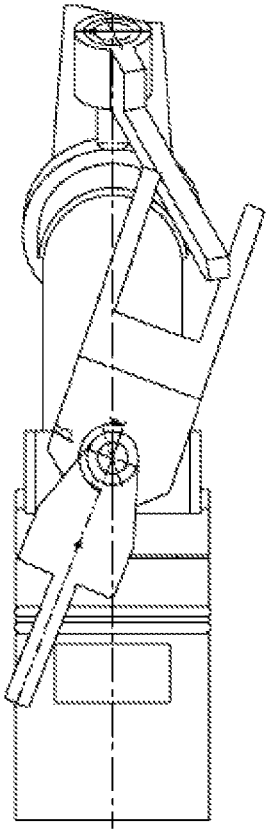
FIG. 7 is a schematic diagram of the reversing positing block when fluidic sprinkler in reversing position.

As shown in FIG. 5, limiting screw 47 go through the limiting sleeve 9 and fixed on the spray body 36 so as to limit the limiting sleeve 9 rotating with the positioning rod 8. As shown in FIG. 6 and FIG. 7, the included angle between the limiting rod 1 and the center line of the reversing positioning block 10 satisfied $\alpha \leq 170$, $\beta \leq 170°$ in reversing position.

The working of directional controlling mechanism of fluidic sprinkler is first: a stage of stepping rightward. When stepping clockwise, the limiting rod 1 and the reversing positing block 10 are located against left side of the limiting sleeve 9. The rear reversing rod 11 rotates to the right limiting position centered at the rear rotating axis 12 and the front reversing rod 25 rotate to the right limiting position centered at the front rotating axis 24. Meanwhile, the left signal nozzle 42 intakes signal water, which will go through the left signal pipe 39, then enter the right inlet tubule 46 and ultimately flow into the right-side parts of the jet element 27, which is part of the signal water in the jet element 27 adding in main jet meanwhile others stay in vortex region. When the water in the vortex region is accumulated to a critical volume, the pressure difference between the left and right cavities will push main jet to the right side and make the main jet curve. Finally, the main jet attaches to the right wall and the sprinkler will step to the right. Owing to the bending of main jet, the left signal nozzle 42 cannot intake signal water and air passes through the left signal nozzle 42, then enters the left signal pipe 39, and finally flow into the left part through the right inlet tubule 46, the sprinkler will jet straight when the pressure difference between left and right cavity is negligible. The sprinkler steps to the right side by switching stepping state and jet straight state repeatedly.

The second stage involves switching from stepping to the right side to stepping to the left side. The limiting rod 1 moves in a vertical direction gradually resisting the limiting ring 2 when the limiting rod 1 has moved to the position touching the limiting ring 2. When the limiting rod 1 moves beyond the vertical position, in the force of the adjusting spring 4, the limiting rod 1 swing rapidly to the position where it touches the right side of the limiting sleeve 9. At this time, the rotation of the limiting rod 1 will drive the rotation of the reversing positing block 10 to the right side, which tough with the limiting sleeve 9. The rotation of the reversing positing block 10 will drive the rotation to the rear reversing rod 11 to the left side, with the rotation centered at the rear rotating axis 12. The rotation of the rear reversing rod 11 will result in positive reversal of the spring sleeve 20. With the force of the reversing spring 18, the front reversing rod 25 rotates to the left side centered at the front rotating axis 24 and the reversing arm 40, which is fixed at the top of the front reversing rod 25, rotates at the same time, such that switching of intake of the left signal nozzle 42 and the right signal nozzle 43 is realized, and the stage of stepping to the right side switch into stepping to the left side is completed.

The next stage is stepping to the left side when the limiting rod 1 and the reversing positing block 10 are positioned against right side of the limiting sleeve 9. The rear reversing rod 11 rotates centered at the rear rotating axis 12 to the left limiting position and the front reversing rod 25 rotates centered at the front rotating axis 24 to the left limiting position. Meanwhile the right signal nozzle 43 intakes signal water, which enters through the right signal pipe 45, then enters the left inlet tubule 38 and ultimately flows into the right parts of the jet element 27. Part of the signal water in the jet element 27 is added into the main jet, meanwhile other parts stay in vortex region. When the water in the vortex region is accumulated to a critical volume, the pressure difference between the left and right cavities will push main jet to left side and make main jet curve. Finally, the main jet attaches the right wall and the sprinkler will begin stepping to the left side. Owing to the bending of main jet, the right signal nozzle 43 cannot intake signal water causing air to pass through the right signal nozzle 43, then enter the right signal pipe 45, and finally flowing into the left part through the left inlet tubule 38. The sprinkler will jet straight when the pressure difference between left and right cavity is tiny. The sprinkler will step to the left side by switching stepping state and jet straight state repeatedly.

The final stage is that of switching from stepping to the left side into stepping to the right side. The limiting rod 1 moves in the vertical direction gradually resisting the limiting ring 2 when the limiting rod 1 moves to the position touching with the limiting ring 2. When the limiting rod 1 moves beyond the vertical position, with force of the adjusting spring 4, the limiting rod 1 swing rapidly to the position touching with left side of the limiting sleeve 9, at this time, rotation of the limiting rod 1 will drive the rotation of the reversing positing block 10 to the left side, which touch with the limiting sleeve 9. Rotation of the reversing positing block 10 will drive the rotation of the rear reversing rod 11 to the right side centered at the rear rotating axis 12. The rotation of the rear reversing rod 11 will result in positive reversing of the spring sleeve 20. With the force of the reversing spring 18, the front reversing rod 25 rotates to the right side centered at the front rotating axis 24. The reversing arm 40 is fixed at the top of the front reversing rod 25 and rotates at the same time, such that switching of the intake of the left signal nozzle 42 and the right signal nozzle 43 is realized. The stage of stepping to the left side switching into stepping to the right side is thereby completed.

In the description of the present specification, meaning of reference terms such as "an embodiment," "some embodiments," "example," "specific example," "some examples" is that specific features, structures, materials or features of example or embodiment is included in one more example or embodiment of the present application. In the present specification, diagrammatic representations of the terms above have not been directed at the same examples or examples. Furthermore, the specific features, structures, materials, or characteristics of the description can be combined in any one or more embodiments or examples in a suitable manner. In addition, one of ordinary skill in the art can combine different embodiments or examples described in this specification.

Although embodiment of the present application is described above, it is understandable that the embodiment is exemplary, could not be interpreted as the limiting to the application, ordinary technical staff in the field is able to change, modify, replace and distort within the scope of the present application

We claim:

1. A directional controlling mechanism of fluidic sprinkler, comprising a rear reversing mechanism;

a front reversing mechanism; and a signal stream switching mechanism;

wherein the front reversing mechanism comprises a rear reversing rod, a rear rotation axis, a first bearing, a third pin, a fourth pin, a second spacer pin, a shim, a reversing spring, a fifth pin, a spring sleeve, a locating axis, a second bearing, a sixth pin, a front rotation axis, a front reversing rod, an extension plate, a pre-stressed bolt, a short supporting bar, a minor spacing ring, a reversing plate, a medium spacing ring, a jet tube, a larger spacing ring;

wherein the minor spacing ring, the medium spacing ring and the larger spacing ring are respectively fixed on the outside of the jet tube by the fastening bolt;

wherein the rear rotation axis is arranged on the larger spacing ring, the first bearing is set between the rear reversing rod and the rear rotation axis, the third pin is inserted through the hole on the top of the rear rotation axis for the purpose of limiting the axial shift of the first bearing; the short supporting bar is installed on the minor spacing ring, wherein the fastening bolt is used to fix the extension plate on the top of the short supporting bar, wherein the front rotation axis is arranged in the extension plate, the second bearing is set between the rotation axis and the front reversing rod, the sixth pin is inserted through the hole in the top of the front rotation axis in order to limit the axial movement of the first bearing;

wherein the locating axis is arranged on one end of the front reversing rod, wherein the spring sleeve is set on the locating axis, wherein the fifth pin go through the hole in the top of the locating axis to limit the axial shift of the spring sleeve;

wherein one end of the reversing spring is limited by the second spacer pin and is sheathing in the hole of the rear reversing rod;

wherein the fourth pin is inserted through the hole in the top of the second spacer pin in order to limiting the axial shift of the second spacer pin;

wherein the shim is set in the second spacer pin, so as to reduce the friction force between the second spacer pin and the rear reversing rod;

wherein the reversing plate press the outside of the medium spacing ring by tightening the bolt, so as to restrict the rotation angle of the second spacer pin and the front reversing rod.

2. The directional controlling mechanism of fluidic sprinkler of claim 1, further comprising, the rear reversing mechanism has a structure including a limiting rod, a limit ring, a first limiting pin, a adjusting spring, a sleeve, a first pin, a second pin, a locating rod, a limiting sleeve, a reversing positioning block, a spray body and a limiting bolt;

wherein the locating rod is installed in the spray body, and the limiting sleeve is pressed on the outside of the spray body;

wherein the limiting bolt in the spray body is inserted through the limiting sleeve, and the limiting sleeve revolves around the locating rod;

wherein the limiting rod and the reversing positioning block are respectively set in the locating rod;

wherein the second pin is fixed on the locating rod, so as to discourage the limiting rod from out of moving axially along the locating rod; and wherein the sleeve is positioned on the inner side of the reversing positioning block by the first pin, the adjusting spring is sheathed in the sleeve, and the first limiting pin in the adjusting spring limit the position of the lower end of the adjusting spring.

3. The directional controlling mechanism of fluidic sprinkler according to claim 1, further comprising, the signal stream switching mechanism has a structure including a left inlet tubule, a left signal pipe, a reversing arm, a left supporting rod, a left signal nozzle, a right signal nozzle, a right supporting rod, a right signal pipe, and a right inlet tubule;

wherein the reversing arm is fixed on the fore-end of the front reversing rod, the left supporting rod and right supporting rod are all fitted in the reversing arm;

wherein the left signal nozzle and the right signal nozzle are respectively fixed in the hole of the left supporting rod and right supporting rod by pre-tightening bolt;

wherein the left inlet tubule and the right inlet tubule are arranged on the fluidic element; and wherein the left inlet tubule on the left side is connected with the right inlet tubule through the left signal pipe, and the right signal nozzle is connected with the left inlet tubule through the right signal pipe.

4. The directional controlling mechanism of fluidic sprinkler according to claim 1, wherein, the first bearing has a structure comprising two bearings, such that the displacement in the vertical direction is limited and the frictional resistance between the rear reversing rod and the rear rotation axis is reduced.

5. The directional controlling mechanism of fluidic sprinkler according to claim 2, wherein the included angle between the limiting rod and the center line of the reversing positioning block satisfied $\alpha \leq 170$, $\beta \leq 170°$ in reversing position.

6. The directional controlling mechanism of fluidic sprinkler according to claim 3, wherein the axis of rear rotation axis, the front rotation axis and the spray body are in the same section.

7. The directional controlling mechanism of fluidic sprinkler according to claim 3, wherein the rotation angle of the front reversing rod meet $5° \leq \gamma \leq 15°$.

8. The directional controlling mechanism of fluidic sprinkler according to claim 3, wherein the distance between the cover plate and the inlet center of the left signal nozzle and the right signal nozzle is 1 mm$\leq L \leq$2 mm. The deflection between the left signal nozzle and lever is $\varepsilon \leq 15°$, and the deflection between the right signal nozzle and lever is $\delta \leq 15°$.

* * * * *